US007665381B2

(12) United States Patent
Iekura et al.

(10) Patent No.: US 7,665,381 B2
(45) Date of Patent: Feb. 23, 2010

(54) CONTROL DEVICE FOR MARINE PROPULSION SYSTEM

(75) Inventors: Shuji Iekura, Hamamatsu (JP); Eifu Watanabe, Hamamatsu (JP)

(73) Assignee: Yamaha Hatsudoki Kabushiki Kaisha, Shizuoka (JP)

( * ) Notice: Subject to any disclaimer, the term of this patent is extended or adjusted under 35 U.S.C. 154(b) by 452 days.

(21) Appl. No.: 11/406,076

(22) Filed: Apr. 18, 2006

(65) Prior Publication Data

US 2006/0230871 A1 Oct. 19, 2006

(30) Foreign Application Priority Data

Apr. 18, 2005 (JP) ..... 2005-119485
Apr. 18, 2005 (JP) ..... 2005-119490

(51) Int. Cl.
*B63H 21/00* (2006.01)
*B63H 21/22* (2006.01)

(52) U.S. Cl. ..... 74/480 B; 74/473.3; 74/479.01; 74/523; 74/557; 440/84; 440/85; 440/86; 440/87

(58) Field of Classification Search ..... 74/557, 74/523, 480 B, 471.1, 473.3, 479.01, 481; 440/84–87; 244/220, 221, 229, 230
See application file for complete search history.

(56) References Cited

U.S. PATENT DOCUMENTS 1,269,581 A * 6/1918 Daimler ..... 74/471 R
1,889,295 A * 11/1932 Rosatelli ..... 74/471 R
2,361,809 A * 10/1944 Batterson ..... 174/46
2,406,872 A * 9/1946 Waite ..... 74/471 R
2,529,182 A * 11/1950 Panish ..... 477/113
2,579,959 A * 12/1951 Petersen ..... 74/480 R
2,613,547 A * 10/1952 Stewart ..... 74/471 R
3,616,869 A * 11/1971 Rilling ..... 180/6.48
4,012,015 A * 3/1977 Nelson et al. ..... 244/220
4,119,186 A * 10/1978 Choudhury et al. ..... 477/113
4,337,503 A * 6/1982 Turner ..... 362/474
RE31,646 E * 8/1984 Beals et al. ..... 180/78
4,801,282 A * 1/1989 Ogawa et al. ..... 440/84

FOREIGN PATENT DOCUMENTS

JP 10-198415 7/1998

OTHER PUBLICATIONS

PCaviator, GoFlight Throttle system, Apr. 7, 2004, http://web.archive.org/web/20040407003905/http://www.pcaviator.com/shop/viewAProduct.php?pid=125.*
ELITE console MEL webpage, http://web.archive.org/web/20040810035316/http://flyelite.com/hardware.php?product_id=20.*

* cited by examiner

*Primary Examiner*—Richard W L Ridley
*Assistant Examiner*—Thomas Diaz
(74) *Attorney, Agent, or Firm*—Keating & Bennett, LLP

(57) ABSTRACT

A control device for a marine propulsion system includes a base and at least two levers. Each one of the levers is supported by the base at a first end for pivotal movement about a common pivot axis and extending generally normal to the pivot axis to have a second end. The second end has a grip. The grip of one of the levers extends toward the second end of the other one of the levers. The respective grips are nested with each other when the levers extend generally parallel to each other.

14 Claims, 11 Drawing Sheets

CONTROL DEVICE FOR MARINE PROPULSION SYSTEM

PRIORITY INFORMATION

This application is based on and claims priority under 35 U.S.C. § 119 to Japanese Patent Applications No. 2005-119485, filed on Apr. 18, 2005, and No. 2005-119490, filed on Apr. 18, 2005, the entire contents of which are hereby expressly incorporated by reference.

BACKGROUND OF THE INVENTION

1. Field of the Invention

The present invention generally relates to a control device for a marine propulsion system, and more particularly relates to a remote control device for controlling at least two marine propulsion systems.

2. Description of Related Art

Marine propulsion systems such as, for example, outboard motors are typically used for propelling a small watercraft. Multiple outboard motors can be mounted on a single watercraft for propelling the watercraft more powerfully. Typically, a remote control device is used for controlling operations of those outboard motors. The remote control device can be placed in a cockpit of the watercraft. More specifically, the remote control device is usually fixed to a console in the cockpit.

Such a remote control device has multiple control levers corresponding to the respective outboard motors. Each lever can be connected to the associated outboard motor through a mechanical or electrical system. Typically, a throttle valve opening and a shiftable transmission of each outboard motor are controlled using a single lever of the remote control device.

Japanese Patent Publication JP-A-Hei10-198415 discloses such a remote control device. The remote control device disclosed in this Publication has two control levers corresponding to two outboard motors. Each control lever can change a throttle valve opening of an engine of the associated outboard motor and also can change a condition of a transmission of the same outboard motor among forward, reverse and neutral positions.

The respective levers can pivot about a common axis thereof. Normally, an operator of the watercraft operates both of the levers, although the operator can individually operate the respective levers. Each lever has a grip at its distal end. The respective grips oppose to each other when the levers extend parallel to each other. The grips extend toward the other grip for a certain length so that the reaction force of the respective levers can disperse to a relatively broad area of the operator's palm when the operator holds both of the grips. Thus, the operator can control the operations of the respective outboard motors simultaneously and similarly using one hand.

Operator hand size, however, is multifarious. An operator having a relatively small hand may feel uncomfortable holding both of the levers. Even another operator who has a larger hand may feel uncomfortable if the number of the levers is three or more.

SUMMARY OF THE INVENTION

A need thus exists for a control device for a marine propulsion system that has multiple control levers that can be easily held by most operators.

To address such needs, in accordance with one aspect of the present invention, a control device for a marine propulsion system includes a base and at least two levers. Each lever is supported by the base at a first end for pivotal movement about a common pivotal axis. The lever extends generally normal to the pivot axis _____ has a second end opposite of the first end. The second end has a grip. The grip of one of the levers extends toward the second end of the other one of the levers. The respective grips are nested with each other when the levers extend generally parallel to each other.

In accordance with another aspect of the present invention, a control device for a marine propulsion system includes a base, at least two outer levers, and one intermediate lever interposed between the two outer levers. Each one of the outer and intermediate levers is supported by the base at a first end for pivotal movement about a common pivot axis and extends generally normal to the pivotal axis. Each lever also has a second end opposite of the first end. The second end of each outer lever has a grip extending toward the second end of the intermediate lever. The second end of the intermediate lever has grips extending toward the second ends of the respective outer levers. The respective grips are nested with each other when the levers extend generally parallel to each other.

BRIEF DESCRIPTION OF THE DRAWINGS

These and other features, aspects and advantages of the present invention are now described with reference to the drawings of preferred embodiments, which are intended to illustrate and not to limit the present invention. The drawings include eleven figures in which.

DETAILED DESCRIPTION OF THE INVENTION

Figure 1:
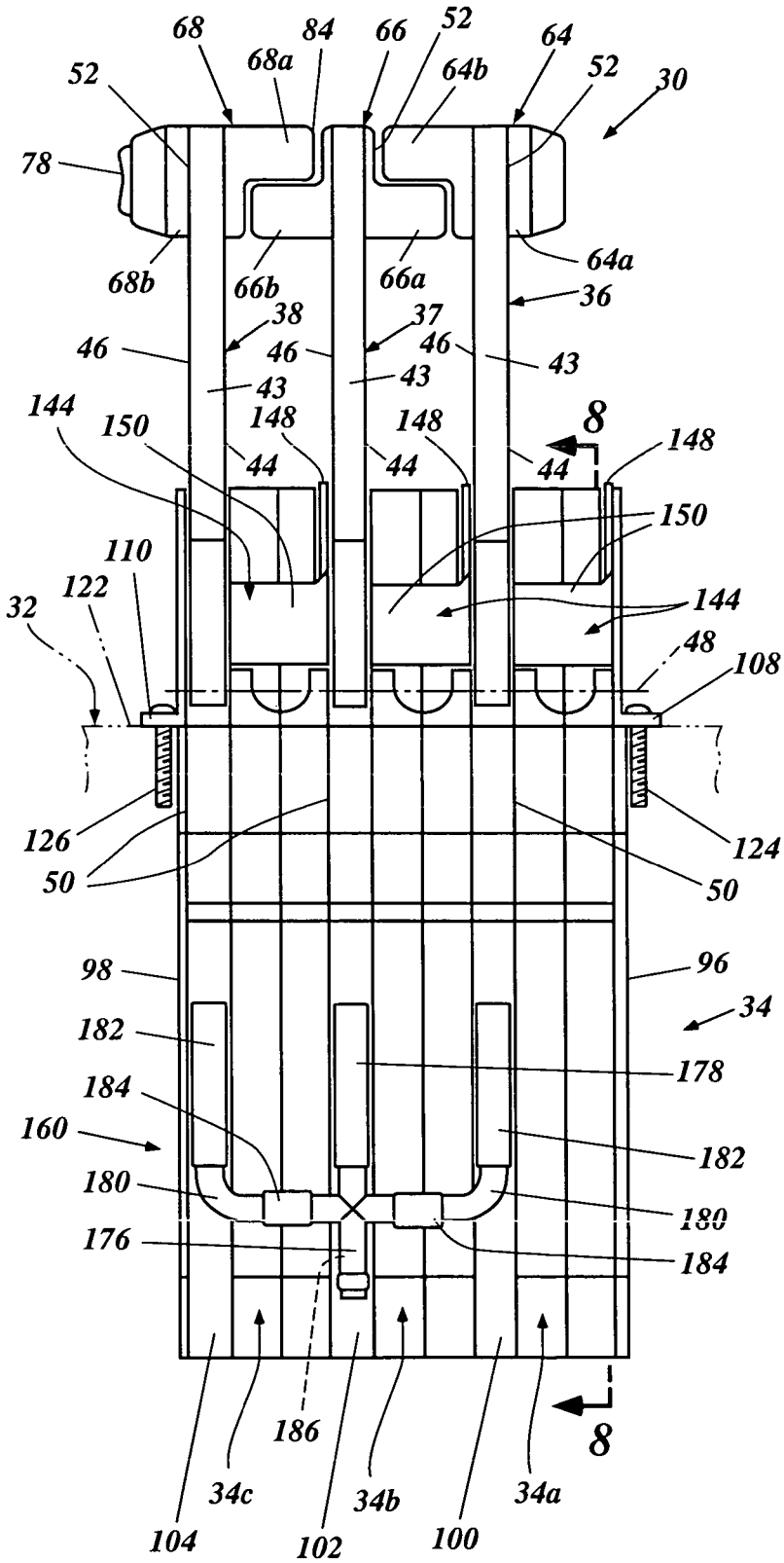
FIG. 1 is a rear elevational view of a remote control device that is configured in accordance with a preferred embodiment of the present invention, with its housing removed, and a console shown in part by the phantom line to which the control device is fixed.

With reference to FIGS. 1-9, a preferred structure of a remote control device 30 that can apply to a marine propulsion system will be described below.

Specifically, the marine propulsion system in this embodiment includes three outboard motors mounted on a transom board of a small watercraft. The marine propulsion system can include other number of outboard motors such as, for example, two or four outboard motors. Also the marine propulsion system can include any propulsion devices other than the outboard motors, such as, for example, stern drive units driven by individual prime movers.

As used through this description, the terms "front" and "forward" mean at or to the side where the bow of the associated watercraft is located or a portion of the control device 30 is located closer to the bow of the watercraft, unless indicated otherwise or otherwise readily apparent from the context used. The terms "rear," "rearward," "reverse" and "backward" mean at or to the opposite side of the front side. The term "right" and "rightward" means at or to the side where the right hand of an operator locates when the operator looks ahead of the watercraft, while the term "left" and "leftward" means at or to the side where the left hand of the operator locates when the operator looks ahead of the watercraft.

Also, as used in this description, the term "horizontally" means that the subject portions, members or components extend generally parallel to the water surface when the watercraft is substantially stationary with respect to the water surface and when the outboard motors are not tilted. The term "vertically" means that portions, members or components extend generally normal to those that extend horizontally.

The control device 30 is attached to a console 32 disposed in a cockpit of the small watercraft. Preferably, the control device 30 is placed relatively on a starboard side of the console.

The control device 30 can change shift positions of respective transmissions of the outboard motors among forward, reverse and neutral positions. When the transmission of each outboard motor is shifted to the forward position, a propulsion device such as, for example, a propeller of the outboard motor rotates in one direction for generating a forward thrust to propel the watercraft forward. When the transmission is shifted to the reverse position, the associated propulsion device rotates in the other direction (i.e., reverse direction) for generating a backward thrust to propel the watercraft backward. When the transmission is shifted to the neutral position, the propulsion device does not rotate so that the watercraft is not propelled (e.g., is at a standstill or stops).

The control device 30 can also change throttle valve openings of respective engines of the outboard motors between an almost fully closed or idle position and a fully open position. When the throttle valve opening is placed at the almost fully closed position, the associated engine operates in an idle state. With the throttle valve opening approaching the fully open position, the engine operates at a higher engine speed to provide more powerful thrust force to the watercraft. When the throttle valve opening reaches the fully open position, the engine operates at the highest engine speed, and the watercraft can move quickly.

The remote control device 30 preferably includes a base 34 and three control levers 36, 37, 38 extending from the base 34.

Figure 6:
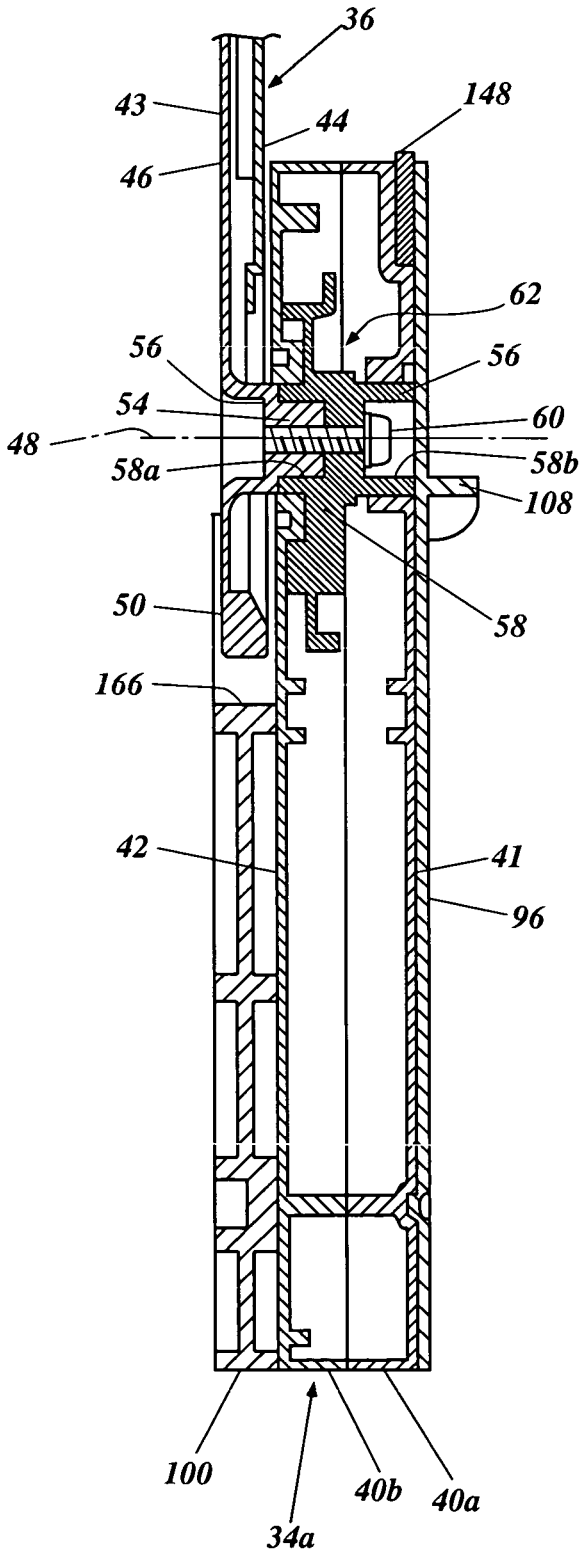
FIG. 6 is a cross sectional view of the control device taken along the line 6-6 of FIG. 2, showing one set of a control lever and a base section positioned on the right side.

As shown in FIGS. 1 and 6, the base 34 in this embodiment is formed with three base sections 34*a*, 34*b*, 34*c* which are separated from each other. FIG. 6 shows a set of the base section 34*a* and the control lever 36 positioned on the right side as representing other sets of the base sections 34*b*, 34*c* and the control levers 37, 38. Preferably, the base section 34*a* has a right piece 40*a* and a left piece 40*b*. Each piece 40*a*, 40*b* generally has a rectangular shape in cross section. One side of each piece 40*a*, 40*b* is an open end. The right and left pieces 40*a*, 40*b* are generally symmetrically shaped with each other relative to a plane including the respective open ends. The right and left pieces 40*a*, 40*b* are coupled together by screws (not shown) in such a manner that the respective open ends oppose to each other so as to form each base section 34*a*, 34*b*, 34*c* as a box-like shape. As thus constructed, as best shown in FIG. 6, each base section 34*a*, 34*b*, 34*c* has a right wall 41 and a left wall 42.

Figure 7:
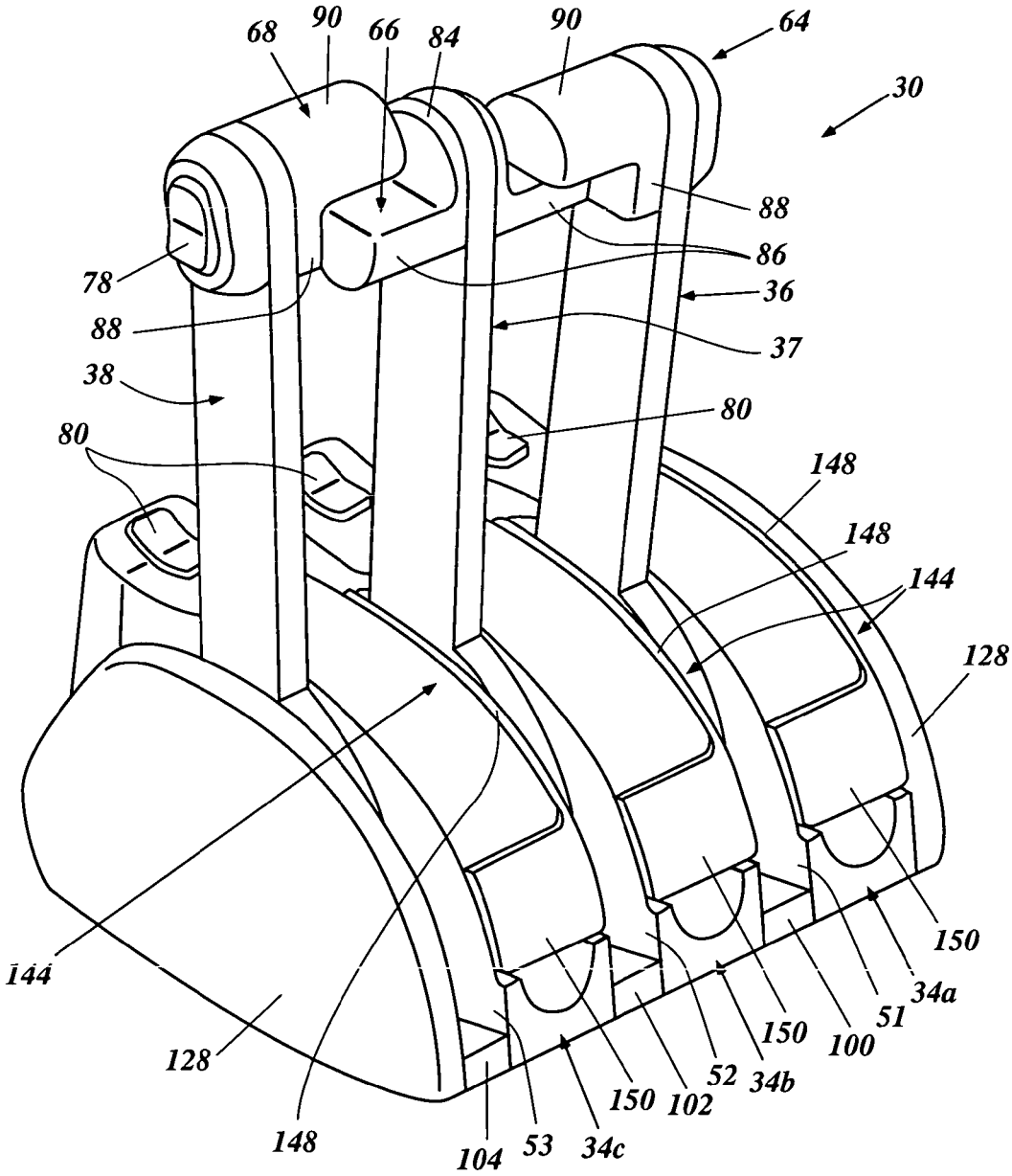
FIG. 7 is a perspective view of the control device under an operating condition, with a base of the control device within the console not shown.

As shown in FIGS. 1 and 7, the control lever 36 is located on the right hand side, while the control lever 38 is located on the left hand side. The control levers 36, 38 interpose the control lever 37 between them.

Each control lever 36, 37, 38 is supported by the respective base section 34*a*, 34*b*, 34*c* at a pivot section or first end 50 for pivotal movement about a common pivot axis 48 and extending generally normal to the pivot axis 48 to have a grip section or second end 52 opposing to the pivot section 50.

Figure 5:
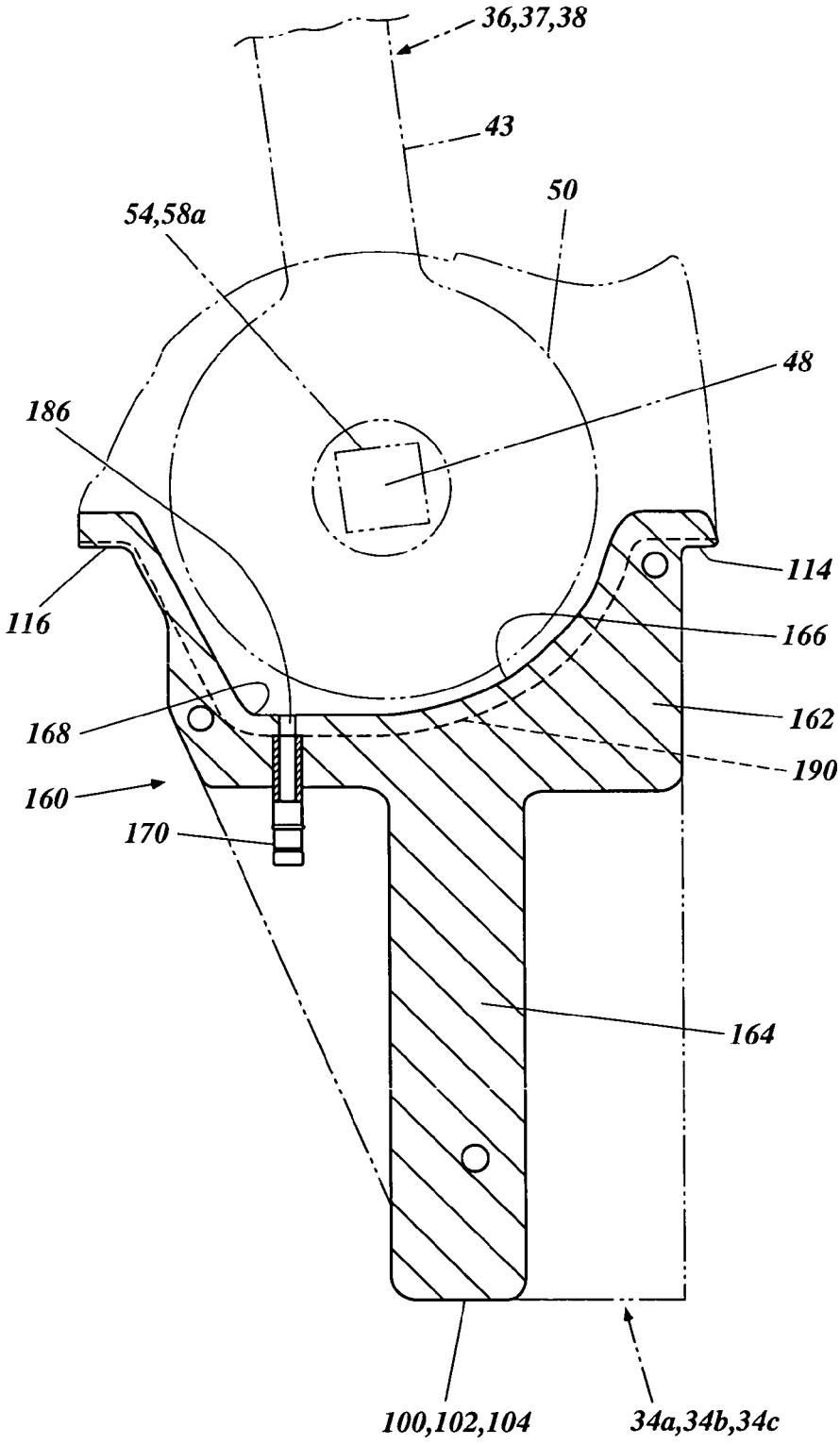
FIG. 5 is a cross sectional view of a spacer of the control device of FIG. 1 with portions of the control device around the spacer shown in phantom.

As shown in FIGS. 5 and 6, each pivot section 50 generally has a circular shape. As best seen in FIG. 6, a center portion 54 of the pivot section 50 protrudes rightward in this embodiment to form a boss. The center portion, i.e., the boss 54, generally has a square shape in its cross section. That is, the boss 54 is a square block.

Each base section 34*a*, 34*b*, 34*c* has right and left apertures 56 extending through its right and left walls 41 and 42, respectively. The axis of the apertures 56 is consistent with the pivot axis 48. A pivot member 58 having a boss is enclosed in a space defined by the right and left pieces 40*a*, 40*b* of each base section 34*a*, 34*b*, 34*c*. The boss of the pivot member 58 has a recess 58*a* which cross section has a square shape that is the same as the boss 54 of the pivot section 50. In the illustrated embodiment, another recess 58*b* is formed oppositely to the recess 58*a*. The recess 58*b* has the same shape and the same size as the recess 58*a*. The structure is useful for interchangeably positioning the control lever 36, 37, 38 at respective sides of the base section 34*a*, 34*b*, 34*c*.

In the illustrated embodiment, the boss of the pivot member 58 is inserted into the left aperture 56 from the interior of the base section 34*a*, 34*b*, 34*c*. The boss 54 of the pivot section 50 of each lever 36, 37, 38 is also inserted into the left aperture 56 to be coupled with the boss of the pivot member 58. More specifically, the boss 54 of the pivot section 50 fits in the recess 58*a* of the pivot member 58. Under this condition, the pivot section 50 and the pivot member 58 interpose the left wall 42 of the base section 34*a*, 34*b*, 34*c* between them.

A screw 60 joins the boss 54 of the pivot section 50 and the boss of the pivot member 58. Consequently, each lever 36, 37, 38 is pivotable together with the associated pivot member 58 about the pivot axis 48. In the illustrated embodiment, the pivot member 58 is a part of a control linkage 62 connecting the control levers 36, 37, 38 to the transmissions and the engines of the respective outboard motors. The control linkage 62 is movable with the pivotal movement of each control lever 36, 37, 38. The control linkage 62 will be described in greater detail below.

Each control lever 36, 37, 38 is formed with a lever body 43 and a grip unit 64, 66, 68. Preferably, the lever body 43 is a generally straightly extending bar. The lever body 43 has the pivot section 50 at its one end and the grip section at another end. The lever body 43 also has a right surface 44 and a left surface 46. The right and left surfaces 44, 46 preferably extend parallel to each other. The respective lever bodies preferably 43 have generally the same configuration and the same size.

Figure 4:
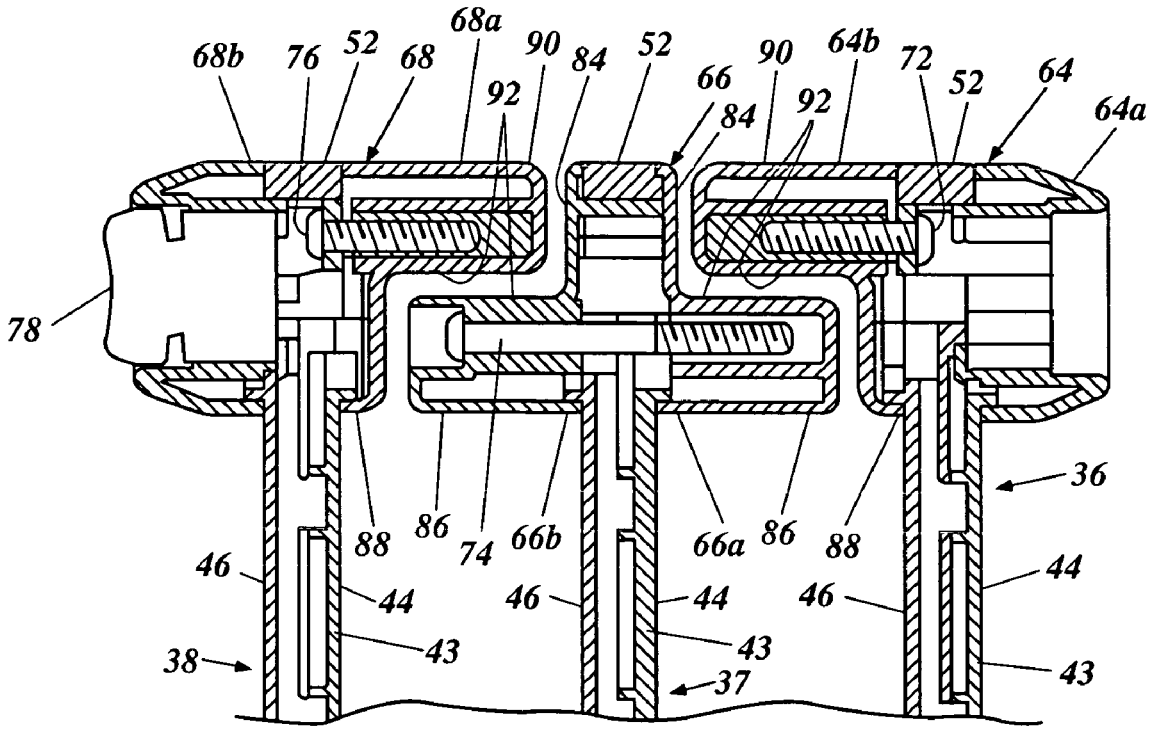
FIG. 4 is a partial cross sectional view of the control device, showing top of respective control levers.

The grip section 52 of the outer lever 36 has the grip unit 64. The grip section 52 of the intermediate lever 37 has the grip unit 66. The grip section 52 of the outer lever 38 has the grip unit 68. As best shown in FIG. 4, in the illustrated embodiment, the grip unit 64 is divided into a grip 64*a* attached to the right surface 44 of the lever body 43 and a grip 64*b* attached to the left surface 46 of the lever body 43. Also, the grip unit 66 is divided into a grip 66*a* attached to the right surface 44 and a grip 66*b* attached to the left surface 46, and the grip unit 68 is divided into a grip 68*a* attached to the right surface 44 and a grip 68*b* attached to the left surface 46.

The grips 64*a*, 64*b* are coupled with each other by a screw 72 under a condition that the respective grips 64*a*, 64*b* interpose the grip section 52 of the outer lever 36 between them. Also, the grips 66*a*, 66*b* are coupled with each other by a screw 74 under a condition that the respective grips 66*a*, 66*b* interpose the grip section 52 of the intermediate lever 37 between them, and the grips 68*a*, 68*b* are coupled with each other by a screw 76 under a condition that the respective grips 68*a*, 68*b* interpose the grip section 52 of the outer lever 38 between them. Thus, all the grip units 64, 66, 68 are detachably fixed to the associated levers 36, 37, 38.

Figure 2:
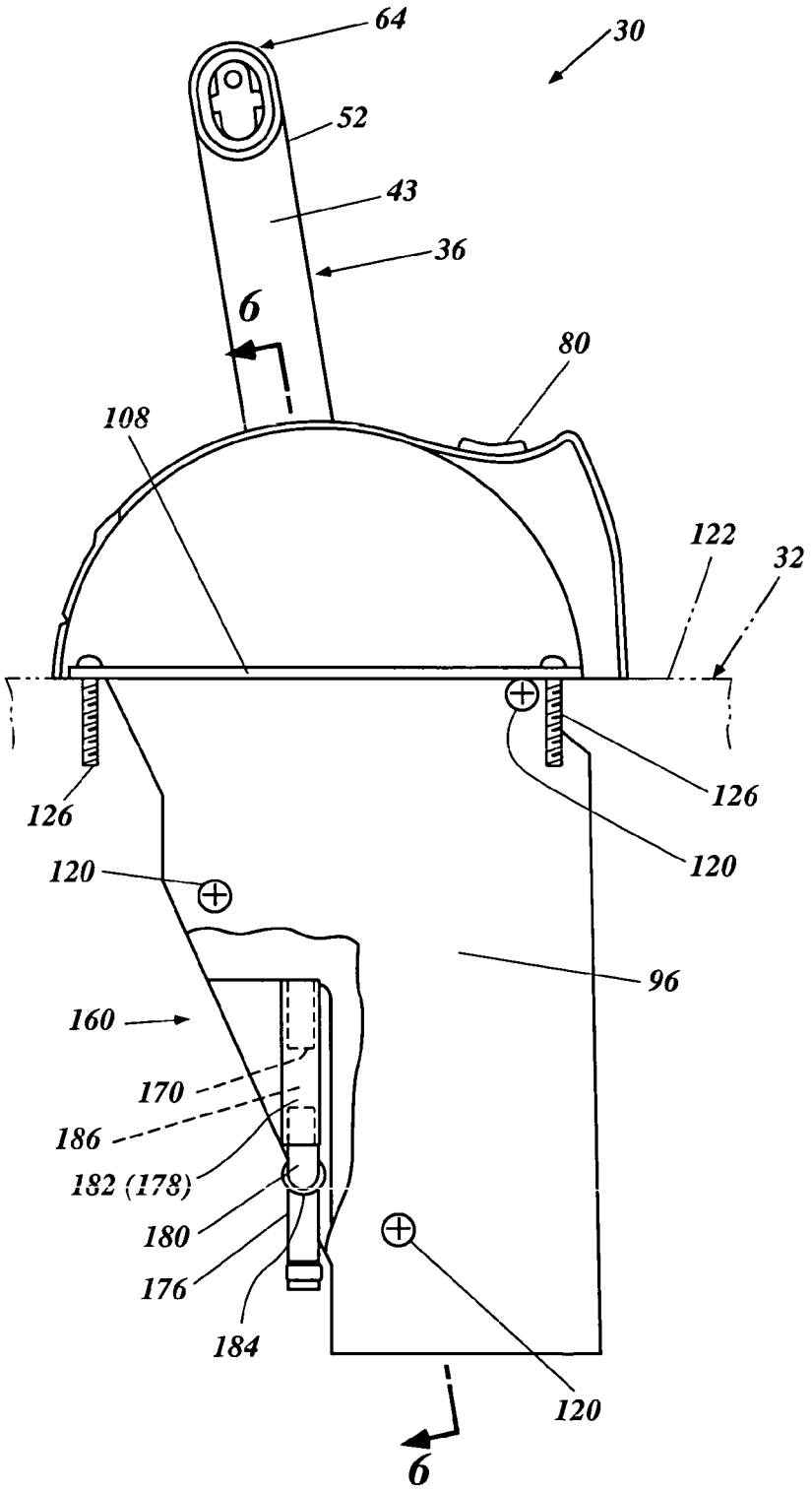
FIG. 2 is a side elevational view of the control device of FIG. 1, the console also shown in part by the phantom line.
Figure 3:
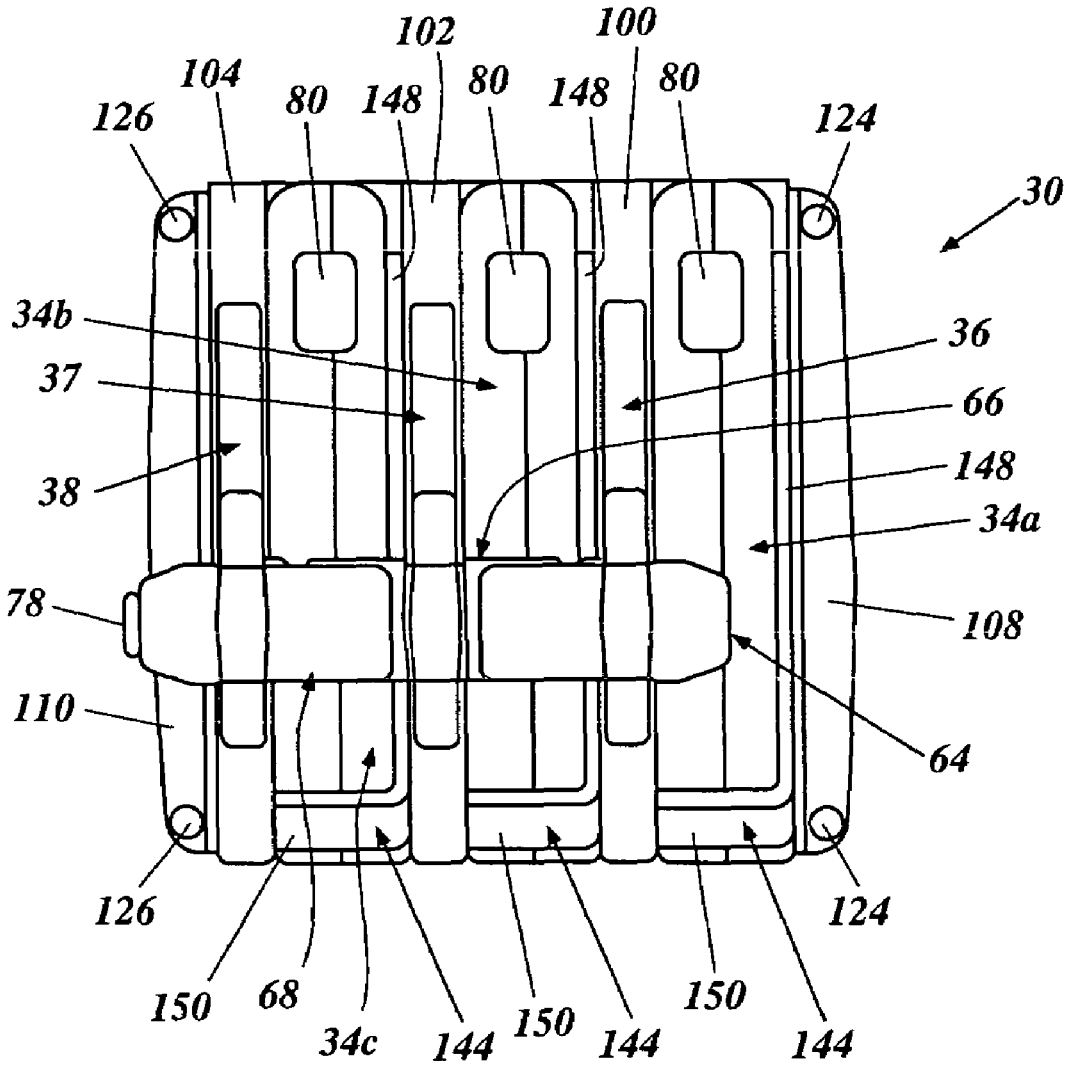
FIG. 3 is a top plan view of the control device.

Preferably, the grips 64*a*, 68*b* have the same shape and the same size, while the grips 64*b*, 68*a* have the same shape and the same size. A switch member 78 is preferably attached to one of the grips 64*a*, 68*b*. In the illustrated embodiment, the switch member 78 is attached to the grip 68 positioned on the left side of the outer lever 38. The switch member 78 is provided for simultaneously changing a trim angle or a tilt angle of the respective outboard motors. When the operator pushes the switch member 78, an electric motor of a hydraulically operable trim and tilt mechanism is activated to operate a hydraulic pump so as to simultaneously raise or lower all the outboard motors. As shown in FIGS. 2, 3 and 7, the illustrated remote control device 30 also has switch members 80 for individually changing the trim or tilt angle of each outboard motor. Each switch member 80 is preferably placed at a front upper portion of the respective base section 34*a*, 34*b*, 34*c* for corresponding to the control levers 36, 37, 38.

With reference to FIG. 4, each grip 66*a*, 66*b* of the intermediate lever 37 preferably has a basal portion 84 and a projection 86. Preferably, the basal portion 84 of the grip 66*a* is attached to the right surface 44 of the lever body 43, and the projection 86 of the grip 66*a* extends rightward from a lower half of the basal portion 84 toward the grip section 52 of the outer lever 36. Also, the basal portion 84 of the grip 66*b* is attached to the left surface 46 of the lever body 43, and the projection 86 of the grip 66*b* extends leftward from a lower half of the basal portion 84 toward the grip section 52 of the outer lever 38.

Each one of the grip 64*b* of the outer lever 36 and the grip 68*a* of the outer lever 38 has a basal portion 88 and a projection 90. Preferably, the basal portion 88 of the grip 64*b* is attached to the left surface 46 of the lever body 43, and the projection 90 of the grip 64*b* extends leftward from an upper half of the basal portion 88 toward the grip section 52 of the intermediate lever 37. Also, the basal portion 88 of the grip 68*a* is attached to the right surface 44 of the lever body 43, and the projection 90 of the grip 68*a* extends rightward from an upper half of the basal portion 88 toward the grip section 52 of the intermediate lever 37.

As thus arranged, the grip 64*b* of the outer lever 36 and the grip 66*a* of the intermediate lever 37 are nested with each other when the levers 36, 37 extend generally parallel to each other, i.e., when both the levers 36, 37 have the same pivotal angle relative to the base 34 of the control device 30. Also, the grip 68*a* of the outer lever 38 and the grip 66*b* of the intermediate lever 37 are nested with each other when the levers 37, 38 extend generally parallel to each other. That is, in the illustrated embodiment, the respective grips 64*b*, 66*a* overlap with each other in a longitudinal direction of each lever 37, 38, i.e., in a normal direction relative to the pivot axis 48, when the levers 36, 37 extend generally parallel to each other, and the respective grips 66*b*, 68*a* overlap with each other in a longitudinal direction of each lever 37, 38, i.e., the normal direction relative to the pivot axis 48, when the levers 37, 38 extend generally parallel to each other.

Preferably, as shown in FIG. 4, each grip 64*b*, 66*a*, 66*b*, 68*a* has a surface 92 which does not extend normal to the pivot axis 48 (see FIG. 1). The surfaces 92 of the respective grips 64*b*, 66*a* oppose to each other when the levers 36, 37 extend parallel to each other. Also, the surfaces 92 of the respective grips 66*b*, 68*a* oppose to each other when the levers 37, 38 extend parallel to each other. In the illustrated embodiment, the surfaces 92 extend generally parallel to the pivot axis 48.

Each illustrated grip 64*b*, 66*a*, 66*b*, 68*a* has a generally cylindrical shape. A portion of the cylindrical shape is cut away to form the surface 92. In other words, the projection 86, 90 is formed as a result that almost a half of the cylindrical shape is removed from each grip 64*b*, 66*a*, 66*b*, 68*a*.

Because of the arrangement discussed above, the levers 36, 37, 38 in the illustrated embodiment can be positioned closer to each other even though the respective grips 64*b*, 66*a*, 66*b*, 68*a* extend transversely (i.e., in the direction of the pivot axis 48). Thus, every operator, even ones with relatively small hands, can easily hold the grips 64*b*, 66*a*, 66*b*, 68*a*.

More specifically, an operator can hold the grip 64*b* generally by one finger that holds the grip 66*a* while holding the grip 68*a* generally by another finger that holds the grip 66*b*. Because the grips 64*b*, 66*a*, 66*b*, 68*a* extend transversely, the holding force of the operator can be sufficiently given to the respective grips 64*b*, 66*a*, 66*b*, 68*a*. In addition, the control device 30 in this embodiment can be compact enough because the respective levers 36, 37, 38 can be positioned closer to each other then in prior control devices.

In one variation, the projections 86 of the grips 66*a*, 66*b* and the projections 90 of the grips 64*b*, 68*a* can be arranged so that the projections 86 are positioned above the projections 90 when the respective control levers 36, 37, 38 extend upward. In another variation, only the projection 86 of the grip 66*a* can be positioned above the projection 90 of the grip 64*b* under the condition that the projection 86 of the grip 66*b* is positioned below the projection 90 of the grip 68*a*. Also, in a further variation, only the projection 86 of the grip 66*b* can be positioned above the projection 90 of the grip 68*a*, and the projection 86 of the grip 66*a* is positioned below the projection 90 of the grip 64*b*.

In the illustrated embodiment, the respective base sections 34*a*, 34*b*, 34*c* are coupled with each other to form the base 34 as a unit. In order to complete the base 34, preferably, a right plate 96, a left plate 98 and three spacers 100, 102, 104 are used. The right plate 96 is attached to the right wall 41 of the base section 34*a*, while the left plate 98 is attached to the left wall 42 of the base section 34*c*. The spacer 100 is interposed between the base sections 34*a*, 34*b* to create a space S1 (FIG. 7) for the outer lever 36. The spacer 102 is interposed between the base sections 34*b*, 34*c* to create a space S2 (FIG. 7) for the intermediate lever 37. The spacer 104 is interposed between the base section 34*c* and the left plate 98 to create a space S3 (FIG. 7) for the outer lever 38. The respective spacers 100, 102, 104 preferably have the same configuration and the same thickness. The spacers 100, 102, 104 will be described in greater detail below.

Figure 8:
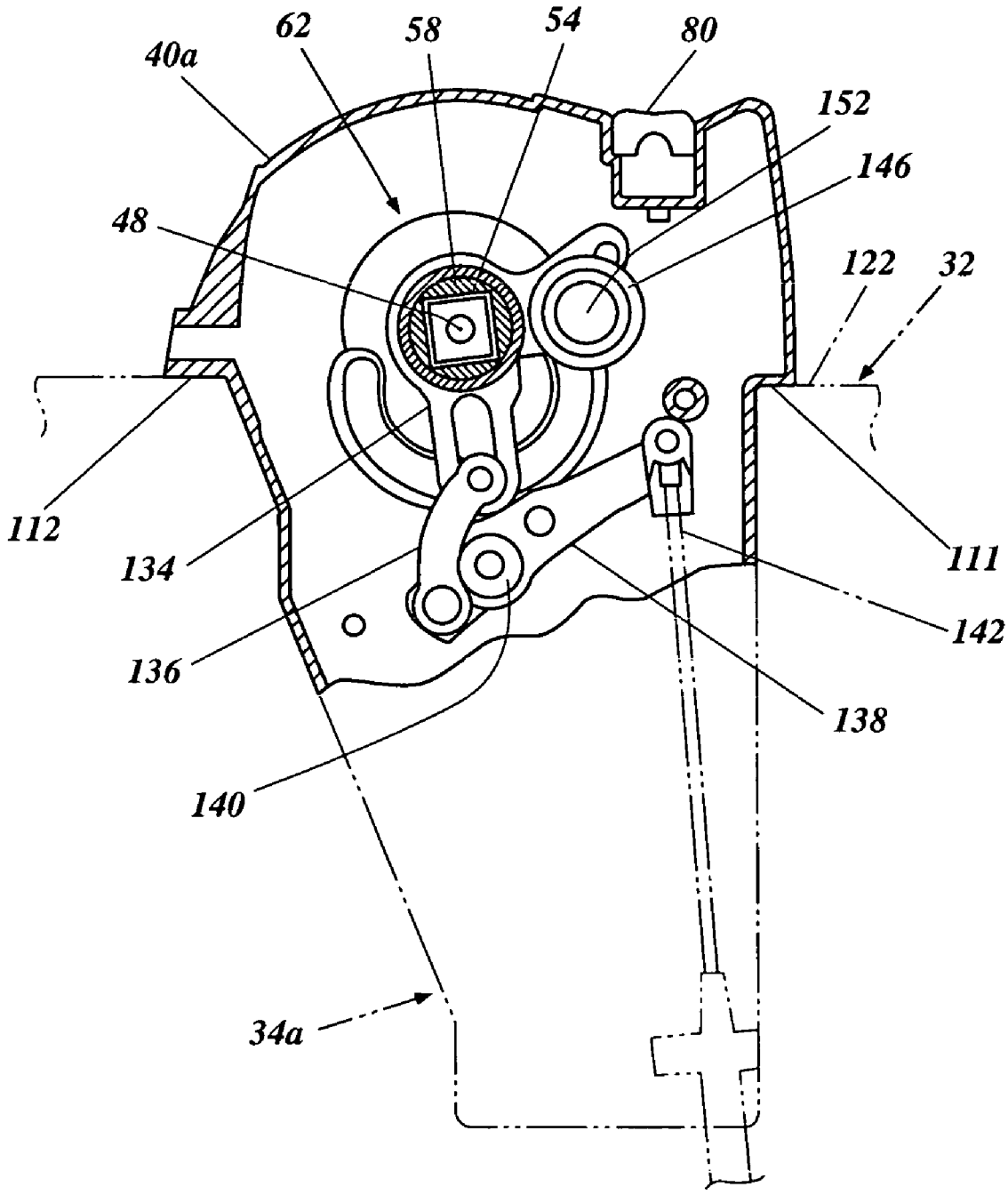
FIG. 8 is a partial cross sectional view of the control device taken along the line 8-8 of FIG. 1, with a lower portion of the base and the console shown in phantom.

As shown in FIGS. 1 and 6, preferably, the right plate 96 has a flange 108 extending generally horizontally rightward from its middle portion located in its vertical direction. Also, as shown in FIG. 1, the left plate 98 has a flange 110 extending generally horizontally leftward from its middle portion located in its vertical direction. In addition, as shown in FIG. 8, the right and left pieces 40*a*, 40*b* of the respective base sections 34*a*, 34*b*, 34*c* preferably have a front step 111 and a rear step 112. That is, upper portions of the respective base sections 34*a*, 34*b*, 34*c* above the steps 111, 112 protrude forward or rearward. As shown in FIG. 5, each spacer 100, 102, 104 also has front and rear steps 114, 116 corresponding to the front and rear steps 111, 112 of the respective base sections 34*a*, 34*b*, 34*c*. The flanges 108, 110 and the steps 111, 112, 114, 116 are preferably formed adjacent to the pivot axis 48 and slightly above the pivot axis 48.

As shown in FIG. 2, the respective base sections 34*a*, 34*b*, 34*c* and the spacers 100, 102, 104 are joined together by a plurality of screws 120 to complete the base 34. The base 34 together with the respective control levers 36, 37, 38 are mounted on the console 32. The flanges 108 of the right plate 96 and the flange 110 of the left plate 98 abut on a top surface 122 of the console 32. Also, the front and rear steps 111, 112 of the respective base sections 34*a*, 34*b*, 34*c*, and the front and rear steps 114, 116 of the respective spacers 100, 102, 104 abut on the top surface 122 of the console 32. Under the condition, as shown in FIGS. 1, 2 and 3, the flange 108 is fixed to the top surface 122 of the console 32 by screws 124, and the flange 110 is also fixed to the top surface 122 by screws 126. Because the flanges 108, 110 are positioned adjacent to the pivot axis 48 and above the pivot axis 48, the pivot axis 48 can extend adjacent to the top surface 122 of the console 32 and above the console 32.

As shown in FIG. 7, face members 128 cover portions of the right and left plates 96, 98 and extend upward beyond the top surface 122 of the console 32, above the level of the flanges 108, 110 and the heads of the screws 124, 126. More specifically, each face member 128 is recessed to entirely surround the portions of the right and left plates 96, 98.

With reference to FIGS. 6 and 8, the control linkage 62 preferably includes sets of a drive member 134, an intermediate link 136 and a driven member 138 other than the pivot member 58. That is, each set of those components 58, 134, 136, 138 corresponds to the respective control lever 36, 37, 38.

The drive member 134 fits on the boss of the pivot member 58 to pivot together with the drive member 134. A lever portion of the drive member 134 is connected to the driven member 138 through the intermediate link 136. The driven member 138 is fixed to the base section 34*a*, 34*b*, 34*c* at a fixed portion 140 and can swing about an axis of the fixed portion 140. The intermediate link 136 is pivotally coupled with the lever portion of the drive member 134 and is also pivotally coupled with an end of the driven member 138. An end of a push-pull wire 142 is pivotally coupled with another end of the driven member 138. The fixed portion 140 is positioned between both ends. Another end of the push-pull wire 142 is connected to the transmission and the throttle valve of the engine of the associated outboard motor.

When the operator operates the control lever 36, 37, 38, the associated pivot member 58 pivots about the pivot axis 48. The drive member 134 drives the driven member 138 through the intermediate link 136. The driven member 138 thus swings about the axis of the fixed portion 140 to push or pull the push-pull wire 142. The push-pull wire 142 operates the transmission and the throttle valve of the associated outboard motor, accordingly.

In the illustrated embodiment, when the control lever 36, 37, 38 extends upward or vertically, the transmission is placed at the neutral position and the throttle valve opening is almost fully closed. The associated outboard motor does not generate the thrust force of the watercraft, even though the idling of its engine is allowed. The watercraft does not move, accordingly.

From this neutral state, while the control lever 36, 37, 38 pivots to incline forward with a certain angle, the transmission is shifted to the forward position and the throttle valve opening becomes larger. The associated outboard motor generates the forward thrust of the watercraft to the extent corresponding to the throttle valve opening. The watercraft thus moves forward.

On the other hand, from the neutral state, while the control lever 36, 37, 38 pivots to incline rearward, the transmission is shifted to the reverse position and the throttle valve opening becomes larger. The associated outboard motor generates the backward thrust of the watercraft to the extent corresponding to the throttle valve opening. The watercraft thus moves backward.

With reference to FIGS. 1, 3, 6, 7 and 8, in the illustrated embodiment, a free throttle lever 144 is additionally provided at each base section 34*a*, 34*b*, 34*c* to be connected to the respective engine of the outboard motor through the control linkage 62 individually and independently from the control linkage 62. The operator can operate the free throttle levers 144 together or individually to race the associated engines.

Each free throttle lever 144 preferably has a pivot shaft 146, a lever body 148 and an operating portion 150. The pivot shaft 146 is positioned adjacent to the pivot member 58. The illustrated lever body 148 is positioned on the right side of each base section 34*a*, 34*b*, 34*c*. That is, the respective free throttle levers 144 extend along the side opposite to the side on which the respective control levers 36, 37, 38 extend. The operating portion 150 extends leftward from an end of each lever body 148. The operating portion 150 is normally positioned at a rear end of the base section 34*a*, 34*b*, 34*c*.

As shown in FIG. 8, an axis 152 of the pivot shaft 146 is offset from the pivot axis 48 and extends generally parallel to the pivot axis 48. The respective free throttle levers 144 can pivot about the axis 152. Although not shown, each pivot shaft 136 is directly connected to the throttle valve of the associated engine through a gear mechanism and a control wire.

As noted above, the remote control device 30 is fixed to the console 32 located in the cockpit of the watercraft. Thus, generally, the control device 30 is protected from water under a normal condition. The cockpit, however, can be exposed to the water under some conditions such as, for example, a stormy condition or a condition that the operator opens windows of the cockpit. In addition, the control device 30 can be mounted on a watercraft that has no cockpit which is covered. Under those exposed conditions, water may accumulate in the spaces S1, S2, S3 above the spacers 100, 102, 103, and may enter the interior of the control device 30.

Figure 11:
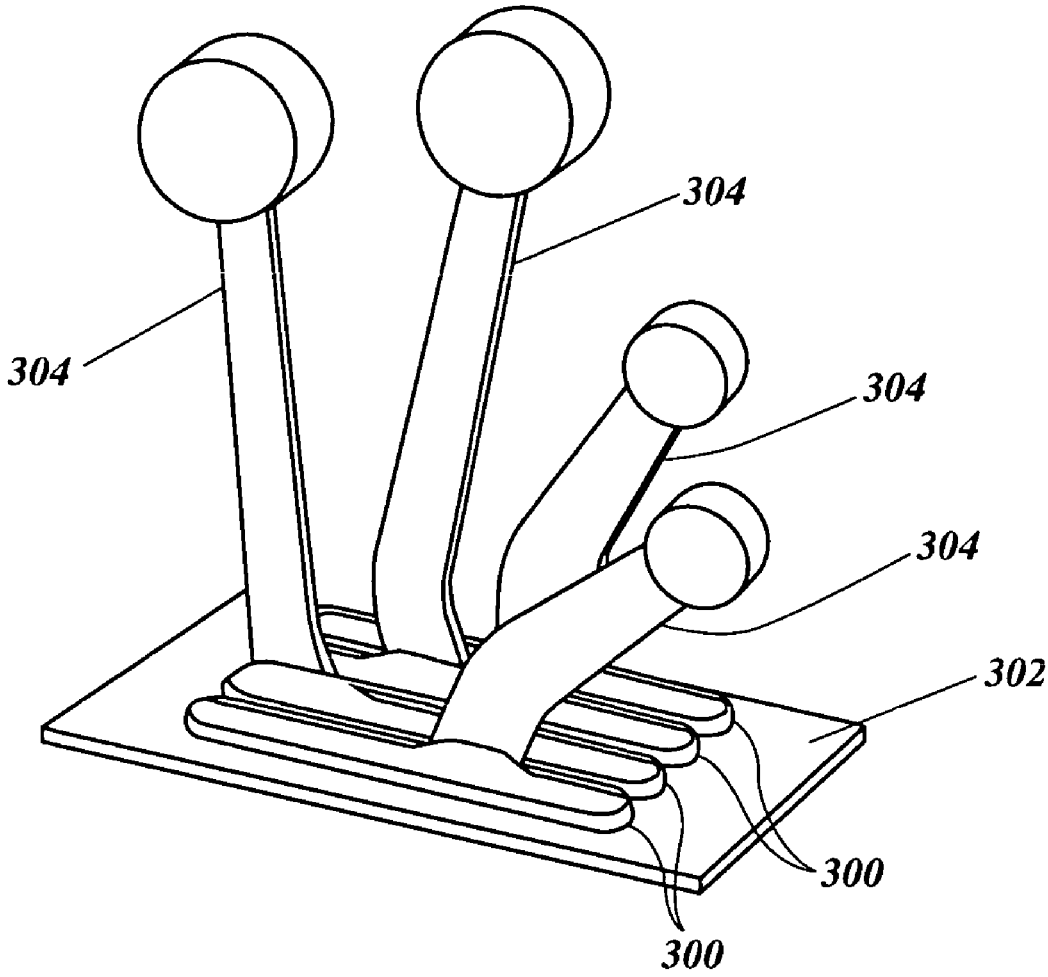
FIG. 11 is a schematic view of a control device having a sealed construction.

A seal structure can be provided for protecting the control device 30 from the water. As schematically shown in FIG. 11, rubber members 300, for example, can seal openings of the control device 302 through which the control levers 304 extending upward However, because of the pivotal movement of the control levers 304, a portion of each rubber member 300 abutting on the respective control lever 304 can make a gap, and water can enter the interior of the control device 302 through the gap. Such a seal structure thus is not so effective.

With reference to FIGS. 1, 2 and 5, in the illustrated embodiment, each spacer 100, 102, 104 has a drain mechanism 160 to solve the above problem. The drain mechanism 160 includes a recess and a drain passage opening to the recess. The recess is formed between each control lever 36, 37, 38 and the associated spacer 100, 102, 104.

Preferably, each spacer 100, 102, 104 is generally shaped as the letter Y. More specifically, each spacer 100, 102, 104 has an upper portion 162 and a lower portion 164. The upper portion 162 generally has the same configuration as the corresponding portion of the control lever 36, 37, 38. The lower portion 164 is narrower than the upper portion 162 and generally has a rectangular shape in a side view. Because each control lever 36, 37, 38 has the pivot section 50 generally circularly shaped, a top end of the upper portion 162 is recessed to form a recess 166.

The illustrated recess 162 defines the recess of the drain mechanism 160 in this embodiment. The recess 166 preferably has a corner 168 which is slightly deeper than the rest of the recess 166. The upper portion 162 of each spacer 100, 102, 104 has a through-hole extending generally vertically. A top end of the through-hole opens to the recess 166. A metallic drain pipe 170 fits into the through-hole.

As shown in FIGS. 1 and 2, a generally cross-shaped metallic joint 176 is connected to a bottom end of the drain pipe 170 positioned at the center through a rubber hose 178. Generally L-shaped metallic joints 180 are connected to respective bottoms of the drain pipes 170 positioned at both sides through rubber hoses 182. Rubber connectors 184 connect the cross-shaped joint 176 and the L-shaped joints 178. A bottom of the cross-shaped metallic joint 176 is connected to a discharge device through an additional rubber hose. The discharge device can have a drain pump. A further additional rubber hose preferably extends to an external location of the control device 30 from the discharge device.

In the illustrated embodiment, the drain pipes 170, the joints 176, 178, the rubber hoses 178, 180, rubber connectors 184 and the additional rubber hose together define a drain passage 186 of the drain mechanism 160 together with a top end of the through-hole.

As shown in FIG. 5, preferably, a seal member 190 is interposed between the respective base sections 34*a*, 34*b*, 34*c* and the respective spacers 100, 102, 104. Each seal member 190 is positioned atop of the spacer 100, 102, 104 so as to extend along the recess 166. The respective seal members 190 are relatively thin and are sheet-like members. Because the seal member 190 is thin, FIG. 6 does not show the seal member 190. The respective seal members 190 are water-tightly interposed to prevent water from falling down along the right or left walls 41, 42 adjoining the spacers 100, 102, 104.

Because of the drain mechanism 160, the water accumulating in the recesses 166 is drained to the external location through the drain mechanism 160. The external location can be previously decided. Thus, water hardly enters the interior of the remote control device 30 or further the interior of the console 32.

In addition, the drain mechanism 160 is relatively simple, because the mechanism 160 uses the spacers 100, 102, 104 that are originally provided for creating the spaces S1, S2, S3. The drain mechanism 160 thus does not raise the production cost of the control device 30.

Water entering the interior of the control device 30 can also be inhibited by the spacer design. That is, in a variation of the spacer design described above, the recess 166 of each spacer 100, 102, 104 is not formed, and a top of each spacer 100, 102, 104 is generally flushed with the top surface 122 of the console 32 or is positioned slightly higher than the top surface 122 of the console 32. In this structure, however, the pivot axis 48 is inevitably positioned higher. The operator thus needs to raise his or her arm while operating the control levers 36, 37, 38. It is not comfortable for the operator. Because the recess 166 is preferably provided and the water in the recess 166 is discharged through the drain mechanism 160 in this embodiment, the pivot axis 48 can be sufficiently lowered and can be kept at almost the same level of the top surface 122 of the console 32.

Some of the units of the control lever and the base section can be removed from the arrangement (i.e., three set unit) discussed above. On the other hand, one or more units of the control lever and the base section can be added to the arrangement.

Figure 9:
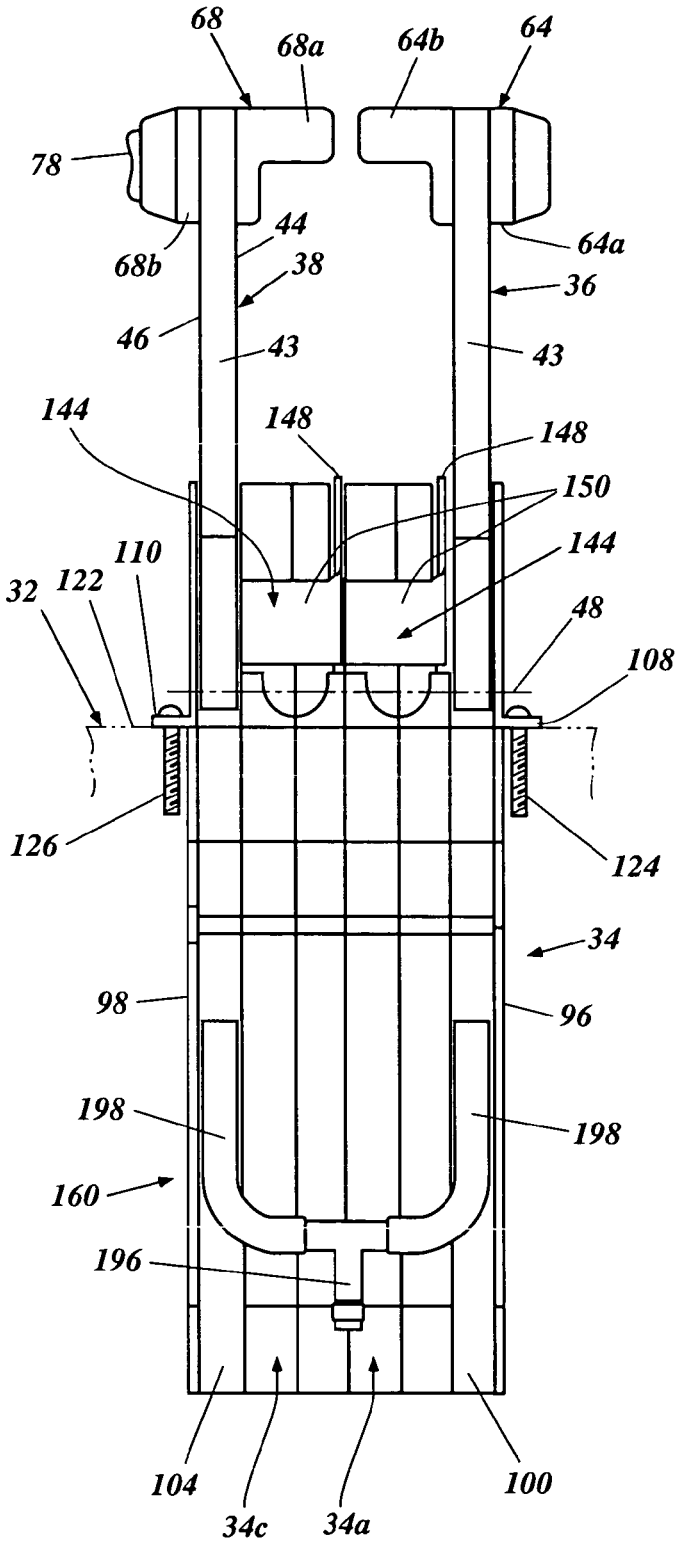
FIG. 9 is a rear view of the control device under a condition that an intermediate lever is removed and an arrangement of one of outer levers is changed.

With reference to FIG. 9, a modified arrangement will be described below. In this modified arrangement, the intermediate set formed with the intermediate lever 37 and base section 34*b* is removed. Thus, the modified arrangement provides a two set unit. It should be noted that the following disassembling and reassembling processes are made in a preferred order; however, the order is changeable.

First, the screws 120 (FIG. 2) are taken away from the three unit assembly to disassemble all the control levers 36, 37, 38, the base sections 34*a*, 34*b*, 34*c*, the spacers 100, 102, 104 and the other components. The intermediate lever 37, the base section 34*b* and the spacer 102 are removed.

The screw 60 (FIG. 6) of the right base section 34*a* is removed. The outer lever 36 of the right base section 34*a* which has been located on the left side is moved to the right side of the right base section 34*a*. In this process, the pivot member 58 stays at the same position, and the boss 54 of the pivot section 50 of the lever 36 is inserted into the other recess 58*b*. The screw 60 is inserted from the side of the left aperture 56 and couples the pivot section 50 of the lever 36 with the pivot member 58.

Then, the grips 64*a*, 64*b* are removed from the right lever 36 and attached to the opposite sides. That is, the grip 64*a* is attached to the surface 46, which has been located on the left side before. Also, the grip 64*b* is attached to the surface 44, which has been located on the right side before. The right lever 36 is positioned on the right side of the right base section 34*a* while the surface 44 faces to the base section 34*a*. In other wards, the right lever 36 is reversed in comparison with the previous positioning.

The right and left base sections 34*a*, 34*c* adjoin with each other. The spacers 100, 104 are attached to the outer sides of the respective base sections 34*a*, 34*c*. The right and left plates 96, 98 are attached to the outer sides of the respective spacers 100, 104. Afterwards, the screws 120 fasten up the units to complete the two set unit.

In this arrangement, the drain mechanism 160 preferably employs a T-shaped joint 196 instead of the cross-shaped joint 176 and the L-shaped joints 180. In addition, preferably, rubber hoses 198 which are longer than the rubber hoses 178, 182 replace the rubber hoses 180.

As described above, the respective base sections together with the associated control levers can be easily disassembled and reassembled. Thus, multiple set units such as, for example, four set unit other than the three set unit and two set unit can be readily obtained corresponding to the number of associated outboard motors.

Figure 10:
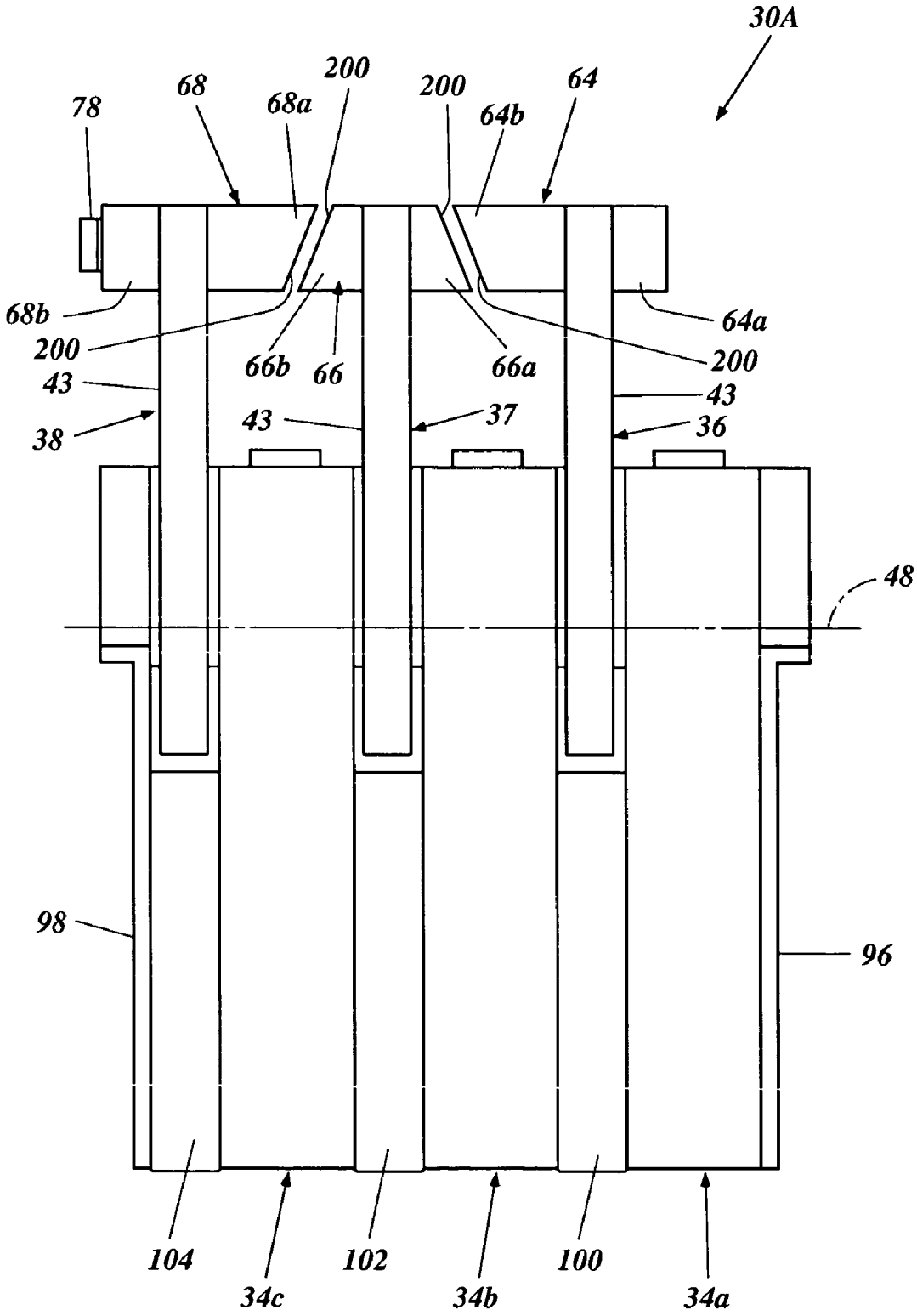
FIG. 10 is a schematic rear view of another control device modified in accordance with a second embodiment of the present invention.

With reference to FIG. 10, another remote control device 30A modified in accordance with a second embodiment of this invention will be described below. The same portions, sections and members as those which have been already described above will be assigned with the same reference numerals or symbols, and will not be repeatedly described unless needed to understand the differences between the embodiments.

Preferably, each grip 64*b*, 66*a*, 66*b*, 68*a* has generally a cylindrical shape. In this embodiment, however, a distal end of each grip 64*b*, 66*a*, 66*b*, 68*a* is obliquely cut away and has a surface 200. The surfaces 200 do not extend normal to the pivot axis 48 nor extend parallel to the pivot axis 48. Rather they are skewed relative to the pivot axis. The surface 200 of the grip 64*b* and the surface 200 of the grip 66*a* oppose to each other and extend generally parallel to each other. Also, the surface 200 of the grip 66*b* and the surface 200 of the grip 68*a* oppose to each other and extend generally parallel to each other. That is, every grip 64*b*, 66*a*, 66*b*, 68*a* preferably has the same oblique angle.

Each grip 64*b*, 66*a*, 66*b*, 68*a* has a trapezoidal-like shape in a rear plan view as shown in FIG. 10. In the illustrated embodiment, a top side of the grip 64*b* has a length longer than its bottom side, while a top side of the grip 66*a* has a length shorter than its bottom side. Also, a top side of the grip 66*b* has a length shorter than its bottom side, while a top side of the grip 68*a* has a length longer than its bottom side.

As thus arranged, the grip 64*b* of the outer lever 36 and the grip 66*a* of the intermediate lever 37 nest with each other when the levers 36, 37 extend generally parallel to each other, i.e., when both the levers 36, 37 have the same pivotal angle relative to the base 34 of the control device 30. Also, the grip 68*a* of the outer lever 38 and the grip 66*b* of the intermediate lever 37 nest with each other when the levers 37, 38 extend generally parallel to each other. That is, in the illustrated embodiment, the respective grips 64*b*, 66*a* overlap with each other in the longitudinal direction of each lever 37, 38, i.e., in the normal direction relative to the pivot axis 48, when the levers 36, 37 extend generally parallel to each other, and the respective grips 66*b*, 68*a* overlap with each other in the longitudinal direction of each lever 37, 38, i.e., the normal direction relative to the pivot axis 48, when the levers 37, 38 extend generally parallel to each other.

The respective grips 64*b*, 66*a*, 66*b*, 68*a* can take any oblique angles. Also, the grip 66*a* can be positioned above the grip 64*b*, or the grip 66*b* can be positioned above the grip 68*a*, under the condition shown in FIG. 10. That is, the relationships between the top and bottom sides of the trapezoidal-like shapes of the respective grips can be reversed.

The grips also can take configurations other than a cylindrical shape as long as they can be nested with each other. For example, the respective grips can be a parallelepiped.

Although this invention has been disclosed in the context of certain preferred embodiments, it will be understood by those skilled in the art that the present invention extends beyond the specifically disclosed embodiments to other alternative embodiments and/or uses of the invention and obvious modifications and equivalents thereof. It is also contemplated that various combinations or sub-combinations of the specific features and aspects of the embodiments may be made and still fall within the scope of the invention. It should be understood that various features and aspects of the disclosed embodiments can be combined with or substituted for one another in order to form varying modes of the disclosed invention. Thus, it is intended that the scope of the present invention herein disclosed should not be limited by the particular disclosed embodiments described above, but should be determined only by a fair reading of the claims that follow.

What is claimed is:

1. A marine propulsion control device comprising:

a base; and at least first and second levers including first and second grips, respectively, each of the first and second levers having a first end and a second end; wherein the first ends of the first and second levers are supported by the base and arranged to pivot about a common pivot axis and the second ends of the first and second levers include the first and second grips, respectively;

an axial length from the first ends to the second ends of the first and second levers is substantially the same such that the second ends of the first and second levers are aligned in a plane substantially perpendicular to the axial length of the first and second levers;

the first grip extends toward the second grip such that a portion of the first grip overlaps a portion of the second grip both in a direction extending along the axial length of the first and second levers and in a direction substantially perpendicular to the axial length of the first and second levers; and each of the first and second grips includes a respective surface which extends generally parallel to the common pivot axis, and the respective surfaces of the first and second grips oppose each other when the first and second levers are aligned in the same place.

2. The marine propulsion control device according to claim 1, wherein the respective surfaces of the first and second grips extend substantially parallel to each other when the respective surfaces of the first and second grips oppose each other.

3. The marine propulsion control device according to claim 1, wherein each of the first and second grips has a substantially cylindrical shape.

4. The marine propulsion control device according to claim 3, wherein portions of the cylindrical shape of the first and second grips is cut away to define the respective surfaces of the first and second grips.

5. The marine propulsion control device according to claim 1, wherein the base includes at least first and second base sections separated from each other, a spacer positioned between the first and second base sections, and one of the first and second levers extends from one of the first and second base sections in a space defined by the spacer.

6. The marine propulsion control device according to claim 5, wherein the first base section includes at least two walls extending substantially parallel to each other, each one of the at least two walls has an aperture having an axis collinear with the common pivot axis, and the first end of the first lever has a portion extending through the apertures so that the first lever is fixed to, and arranged to pivot with respect to, the first base section.

7. The marine propulsion control device according to claim 6, wherein the first grip is arranged to be interchangeably fixed to a first side or a second side of the first lever.

8. The marine propulsion control device according to claim 5, wherein the spacer includes a drain mechanism.

9. The marine propulsion control device according to claim 8, wherein the drain mechanism includes a recess between the first end of the first lever and the spacer, and a drain passage opening to the recess.

10. The marine propulsion control device according to claim 9, wherein the base is arranged to be attached to a console of a watercraft, and the common pivot axis of the first and second levers is arranged to extend adjacent to the console.

11. The marine propulsion control device according to claim 10, wherein the base has a fixing portion arranged to be attached to the console, and the recess is positioned below the fixing portion.

12. The marine propulsion control device according to claim 1, wherein the base is arranged to be attached to a console of a watercraft, and the common pivot axis of the first and second levers is disposed adjacent to the console.

13. A marine propulsion control device comprising:

a base; and a first outer lever including a first grip, a second outer lever including a second grip, and an intermediate lever including an intermediate grip, each of the levers including a first end and a second end; wherein the first ends of the levers are supported by the base and arranged to pivot about a common pivot axis and the second ends of the levers include the grips;

an axial length from the first ends to the second ends of the levers is substantially the same such that the second ends of the levers are aligned in a plane substantially perpendicular to the axial length of the levers; and the first and second grips extend toward the intermediate grip such that a portion of the first grip overlaps a first portion of the intermediate lever both in a direction extending along the axial length of the levers and in a direction substantially perpendicular to the axial length of the levers and a portion of the second grip overlaps a second portion of the intermediate grip both in a direction extending along the axial length of the levers and in a direction substantially perpendicular to the axial length of the levers.

14. The marine propulsion control device according to claim 13, wherein the first and second grips are positioned above the first and second portions of the intermediate grip when the levers are aligned in the same plane.

* * * * *

UNITED STATES PATENT AND TRADEMARK OFFICE

CERTIFICATE OF CORRECTION

PATENT NO. : 7,665,381 B2
APPLICATION NO. : 11/406076
DATED : February 23, 2010
INVENTOR(S) : Iekura et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 583 days.

Signed and Sealed this

Seventh Day of December, 2010

David J. Kappos

David J. Kappos
*Director of the United States Patent and Trademark Office*